United States Patent [19]

McCready

[11] Patent Number: 4,950,372

[45] Date of Patent: Aug. 21, 1990

[54] CATHODIC PROTECTION SYSTEM USING CARBOSIL ANODES

[76] Inventor: David F. McCready, P.O. Box 1971, Altoona, Pa. 16603

[21] Appl. No.: 348,202

[22] Filed: May 5, 1989

Related U.S. Application Data

[60] Division of Ser. No. 166,347, Mar. 10, 1988, Pat. No. 4,828,665, which is a continuation of Ser. No. 20,905, Mar. 2, 1987, abandoned, which is a continuation-in-part of Ser. No. 492,146, May 6, 1983, abandoned, and a continuation-in-part of Ser. No. 880,875, Jul. 1, 1986, abandoned, which is a continuation-in-part of Ser. No. 817,656, Jan. 10, 1985, Pat. No. 4,647,353.

[51] Int. Cl.[5] ..... C23F 13/00

[52] U.S. Cl. ..... 204/147; 204/196

[58] Field of Search ..... 204/196, 147

[56] References Cited

U.S. PATENT DOCUMENTS

| | | | |
|---|---|---|---|
| 3,242,064 | 3/1966 | Byrne | 204/196 |
| 3,498,898 | 3/1970 | Bogart et al. | 204/196 |
| 3,556,971 | 1/1971 | Husock | 204/196 |
| 3,622,489 | 11/1971 | Dumitrescu et al. | 204/196 |
| 3,634,222 | 1/1972 | Stephens, Jr. | 204/196 |
| 3,674,662 | 7/1972 | Haycock | 204/196 |
| 3,714,004 | 1/1973 | Riggs, Jr. et al. | 204/196 |
| 3,953,742 | 4/1976 | Anderson et al. | 204/196 |
| 4,080,272 | 3/1978 | Ferry et al. | 204/196 |
| 4,226,694 | 10/1980 | Baboian et al. | 204/196 |
| 4,383,900 | 5/1983 | Garrett | 204/196 |
| 4,592,818 | 6/1986 | Cavil et al. | 204/196 |
| 4,647,353 | 3/1987 | McCready | 204/196 |
| 4,767,512 | 8/1988 | Cowatch et al. | 204/196 |
| 4,828,665 | 5/1989 | McCready | 204/196 |

*Primary Examiner*—T. Tung
*Assistant Examiner*—Steven P. Marquis
*Attorney, Agent, or Firm*—James Creighton Wray

[57] ABSTRACT

An automotive cathodic protection apparatus applies direct current to an integrated circuit timer and power controller, which generates timed output pulses. An output charge storing capacitor connects the power source and timer to a vehicle body.

19 Claims, 4 Drawing Sheets

CATHODIC PROTECTION SYSTEM USING CARBOSIL ANODES

BACKGROUND OF THE INVENTION

Related U.S. Application Data

This is a division of application Ser. No. 166,347 filed Mar. 10, 1988, U.S. Pat. No. 4,828,665, which was a continuation of application Ser. No. 20,905 filed Mar. 2, 1987, abandoned, which was a continuation-in-part of application Ser. No. 880,875 filed July 1, 1986, abandoned, which was a continuation-in-part of application Ser. No. 817,656 filed Jan. 10, 1985, U.S. Pat. No. 4,647,353. Application Ser. No. 20,905 was also a continuation-in-part of application Ser. No. 492,146 filed May 6, 1983, abandoned.

The invention relates to automotive cathodic protection devices and more in particular to the structures of the anodes used to impress a current within the automotive body, a control for controlling current to the anodes, and a system for cathodic corrosion protection.

Automobiles of all types must be able to cope with varying degrees of inclement weather. When moisture increases, protective measures against automobile body corrosion should be intensified. Extant carbon anodes, controllers and cathodic protective systems are deficient in the ability to respond to varying degrees of moisture. What is needed in the art is a system using carbon anodes which can respond to varying degrees of atmospheric moisture so that as humidity and moisture increase, conductivity to protected surfaces also increases.

The present invention relates generally to the motor vehicle and its susceptibility to corrosion, rusting and deterioration. This corrosion is a result of interactions of metal and electrolytes. The electrolytes may be disarmed by an impressed electrical current commonly known as cathodic protection. This concept has been used in other industrial applications, however, this invention specifically deals with the application of an electric current to automotive body structures as a means of reducing the corrosive activity to these areas.

Since the mid-1950's the vehicle owner has been plagued by ever-increasing use of road salts (for deicing), industrial pollutants and acid rain which, when combined with water, produce a very active electrolyte thereby destroying billions of dollars of transportation equipment annually. The outlook is even grimmer in light of increased concentrations of pollutants and the demand for lighter, more fuel efficient vehicles requiring thinner sheet metal and the abandonment of main frame construction. The common practice of protecting automotive body components from rusting and corrosion has been the application of paints, rubberized and/or asphalt sealers to insulate the electrolyte from the metal. This process has only been marginally successful since it wears away and it is difficult if not impossible to apply thoroughly.

SUMMARY OF THE INVENTION

The invention uses a composite carbon anode in an automotive cathodic protection system with means for attaching it to a car body and effecting good electrical conductivity therewith. The composite material is deemed carbosil which reflects the carbon and silica gel components.

One of the most salient features of the invention is the anode's ability to respond to variations in humidity. It should be appreciated that as humidity increases protective against corrosive forces should also increase. The invention provides an anode which is responsive to variations in humidity such that as humidity increases the electrical conductivity between the anode and the car surface also increases.

A preferred embodiment as described in application 817,656 for an anode apparatus for use in automotive cathodic protection devices comprises a layer of anode enhancement liquid spread upon a bare metal surface. This bare metal surface should have a hole extending therethrough for receiving a fastener. The substantially carbon anode then is mounted on this layer. The anode also has a hole extending therethrough which is to be aligned with the hole on the surface. An electrical lead is then attached to the anode by way of a ring connector. The ring is held in alignment with the holes through which a plastic threaded fastener is inserted and secured on another side of the surface with a plastic nut. The plastic threaded fastener and nut are preferred to be made of plastic such as a nylon or polyamide. This is so that if overtightening occurs the nut will strip before the anode is crushed.

The preferred anode is composed of sintered materials wherein about 90–99% of the material is carbon and preferably 98% is carbon. About 1–9% is silica gel and preferably 2% is silica gel. About 0.1–1% is inert binders and preferably less than 1% is inert binders.

The automotive enhancement liquid comprises about 41% $H_2O$, about 24% polyvinyl acetate-acrylic resin, about 23% calcium silicate pigment, about 4% sodium silicate stabilizer, about 3% of a 10% solution of $H_2PO_3$, about 3% of a 10% solution of tannic acid, about 1.5% glycol esters and about 0.5% inert material.

The preferred anode is about 5/16 of an inch thick.

The method as described in application Ser. No. 817,656 for attaching the inventive anode to the car body for use with automotive cathodic protection devices comprises relatively few steps. One merely bares a patch of metal surface and spreads a layer of the anode enhancement liquid over this bare metal surface. A hole is made on said surface which extends through the surface for attaching purposes. The carbon anode is then placed on this layer. An electrical lead having a ring connector is then attached to the exposed surface of the anode by way of a plastic threaded fastener inserted through the ring connector, the anode and the surface. The threaded fastener is held fast by way of a plastic nut.

An anode enhancement liquid is used on any previously painted metal surface as follows: first the painted surface is removed in an area approximately the same size as the anode. The AEL liquid is spread upon the bare metal to form a jointure between the paint coat and itself prior to fixing the anode to the AEL prepared area. The AEL will supply a predictable and uniform diaelectric reference point. The bonding of the anode to the metal surface is by a nylon screw/nut attachment and/or by Isotac brand adhesive acrylic pressure sensitive double sided tape preferably #Y9469 manufactured by 3M.

It is desirable to use an adhesive such as A-10 "Isotac" Brand Adhesive which is a very firm acrylic pressure-sensitive system. It features very high ultimate bond strength, excellent high temperature and solvent resistance, and excellent shear holding power. Bond strength increases substantially with natural aging.

In one preferred embodiment the paint is cleaned of dirt, dust and wax and/or paint area. A release coating is removed from one side of an anode and the sticky face is pressed against the cleaned surface.

The present invention requires that the ferrous metal surface to be protected be totally precoated with paint as it is presented for consumer use by an automobile manufacturer. The factory painted coating acts as the diaelectric barrier between the cathodically protected ferrous metal and the positively charged carbosil anode. The positively charged anode creates a capacitance between itself and the negatively charged ferrous metal autobody. Electron flow will take place only at breaks or holidays in the painted coating. The electron flow at these holidays provides the free electron source that cathodically protects the iron from oxidation by interfering with the rusting process. The anode is bonded to the factory coating as supplied by the manufacturer through the use of AEL fluid and/or isotac tape and diaelectric nylon screw/nut system. The carbosil anode being sensitive to moisture becomes damp and responsive to ambient moisture. The moisture in close proximity or adjacent to the painted metal surface carries the discharging electrons only through breaks or holidays in the coating. The Carbosil anode's response to moisture facilitates the current flow over the path of least resistance where moisture is greatest.

The present invention requires that the anode when working makes electrical contact with moisture on the painted automobile body. Changes of resistance at the anode are effected by moisture. The greater the moisture, the greater the conductivity, therefore responding directly to increases of corrosion severity with greater current flow. Conversely during very dry periods in the absence of moisture, no electrical current response is needed or produced. In no case will current flow unless a holiday exists in the coating permitting current leakage between the negative ferrous body metal and the carbosil anode. Some anode installations are improved by the use of the Isotac tape described earlier.

In one embodiment of the invention the anode may be attached with the adhesive preferably in the form of a double sided tape directly to the painted surface of an automobile. Alternately, adhesive may be used as a layer coating bare or primed metal.

In a further preferred alternative, the adhesive may attach the anode to anode enhancement layer or automotive enhancement liquid-formed layer as described herein.

The present invention overcomes the corrosive effect of electrolyte present on all automotive body surfaces by impressing an electric current which disarms the activity of this electrolyte. A great deal of variable concentrations of electrolytes exist on an automotive body as well as temperature variations and varied relationships of dissimilar metals. The complex variation of factors has precluded the use of any set value of impressed DC current, and therefore automotive cathodic protection has not been considered feasible, practical, or possible, prior to the present invention.

Cathodic protection has only been used in applications such as underground pipeline where electrolyte concentration and other pertinent characteristics of this phenomena vary only slightly from the norm. The specific function of this invention is to impress an electric DC current to automotive bodies and through the use of integrated circuitry monitor and supply a disarming electric current that will reduce the corrosive destruction thereof.

It is an object of this invention to improve automotive cathodic protection devices by providing novel anode compositions.

It is another object of this invention to provide an anode responsive to variations in humidity.

It is another object of this invention to provide an anode which increases electrical conductivity with metal surfaces in response to increases in humidity.

It is another object of this invention to increase the longevity of automobile bodies.

These and other and further objects and features of the invention are apparent in the disclosure which includes the above and below specification and claims and drawings.

DESCRIPTION OF THE PREFERRED EMBODIMENT

Figure 1:
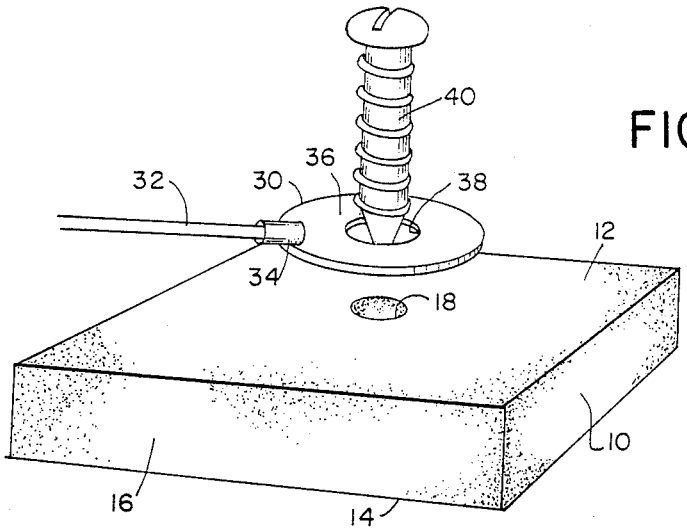
FIG. 1 is an elevated exploded perspective of one embodiment of the invention.

The preferred system uses a carbon anode with accompanying means for attachment to be used with automotive cathodic protection devices. The preferred embodiment is of the impressed-current protection device type.

A preferred anode capsule assembly is described in copending application Ser. No. 203,200 by David McGready and Kenneth Imler filed June 8, 1988.

It is preferred to attach the anode within a protective capsule to a clean painted surface using a double sided adhesive lamina.

When iron and other metals are placed in contact with electrolytes (water and dissolved salts from road de-icers, industrial pollution, etc.), they take on a force that desires release. This force causes the metal to dissolve into the surrounding electrolyte, after which the metals usually combine with oxygen to form oxides (rust corrosion). This is simply the action of metals returning to their most natural state.

Corrosion is a continuous electrical chemical process resulting in the destruction of metals. This corrosion is a direct result of an electrical current caused by the reaction between metal surfaces and existing chemicals found on and about vehicles. These chemicals, referred to as salts, form when substances in the road de-icing agents and industrial air pollutants combine with the atmosphere to produce active electrolytes such as $H_2SO_4$ (common battery acid), HCl, $HNO_3$ and a wide spectrum of additional electrolyte-producing chemicals. Sea spray along coastal areas is another source of destructive electrolyte-producing salts, and corrosion-inducing substances can even be present in the tap water used to wash and preserve a car's finish.

The metal components of cars produce an electrical current when differences in electrical potential exist. These differences in potential are an inherent characteristic of dissimilar metal used in automobile construction. When an electrolyte is present, a path of electrons (electric current) will be released when the electrolyte contacts alloys and bolted or welded areas of the vehicle. The effect of current flow from one portion of the metal through the electrolyte to another part of the structure causes metal ions or particles to leave the surface of the metal. As these particles separate from the structure, combining with the electrolyte, pits develop. These pits act as miniature galvanic (battery) cells. As this electrical chemical process continues, the cells grow larger and larger with the end result being the ultimate destruction of the metal. The rate of this naturally occurring current flow determines the life of the metal. For instance, one ampere of current discharge from iron is sufficient to remove 20.2 pounds of metal in a single year.

With steel, rust is solid evidence of corrosion. Rust has the same chemical composition as hematite, the most common form of iron ore. Steel mills use large amounts of energy to drive off oxygen in converting ore to steel. The reverse process is fairly passive because steel is eager to reunite with oxygen and revert back to its original state as an oxide of iron.

For metal to corrode there must be an anode, a cathode, and a electrolyte with available oxygen (usually damp earth or water). There must also be a potential difference between the anode and the cathode. These conditions set up what is called the "corrosion cell." At the anode, positively charged atoms of the metal leave the solid surface and enter the electrolyte as metallic ions. Current leaves the metal at the anode and migrates through the electrolyte to the cathode. Heat, such as is provided by sunlight, makes the reaction more efficient. This results in rust, pitting, and corrosion at the anode.

Once corrosion starts it is self-sustaining and irreversible. Age and condition of structure, coating, temperature, and other facts influence the rate of corrosion. If not controlled, corrosion, rust and pitting will continue until the metal structure is useless.

A scratch or nick in the protective coating sets the stage for rust and corrosion. When base steel is exposed to the electrolyte, the electro-chemical circuit is established. The steel gives up metallic ions to the electrolyte. A pit forms. Rust is created. The cycle is self-sustaining and will continue until the steel is consumed. Rust is formed by the uniting of the oxygen in the water and metallic ions. Many times this out-of-sight, out-of-mind process goes undetected until severe damage occurs.

A second form of corrosion, called "galvanic corrosion" happens when two dissimilar metals are in contact in the presence of an electrolyte. The metal with the higher potential becomes the anode and the one with the lower potential, the cathode. Such corrosion "cells" rob the higher-potential metal of ions until it is consumed. Metals are listed according to potential in the electromotive, galvanic, series of metals.

From the active end to the noble or passive end there is: magnesium, aluminum, iron (ferrous), cadmium, nickel, tin, brass, copper, silver, monel, titanium, plastinum, graphite, gold.

Any metal higher on the scale sacrifices itself to any metal lower on the scale when the two are in contact in the presence of an electrolyte. Such sacrifice corrosion is the basis for cathodic protection.

The very nature of galvanic corrosion offers an opportunity to use it creatively. This is done by placing expendable and replaceable metal anodes (higher in the galvanic series than steel) in contact with the submerged steel to be protected. The anodes make the entire wetted steel surface a cathode and sacrifice themselves to protect the steel. Thus corrosion is used to fight corrosion.

Another means of controlling corrosion is to reverse the corrosion cell's current flow via an impressed current. Direct current is applied to an anode made of platinum, graphite, cast iron, aluminum or other material based on economic factors. The direct current reverses the galvanic flow from the steel and converts the steel into the protected cathode.

The cathodic device reduces automotive corrosion and rust by using integrated circuitry to impress a DC current on and about the car's body and support structure. This DC current, supplied by the car's battery, impedes the process by which road salts, industrial pollutants, salt air, and acid rain eat away and destroy metal components.

The system comprising the preferred embodiment consists of a command module mounted near the vehicle operator, an interface module located under the dash, and two special electrodes mounted on the front and rear of the car's underbody.

This device fights automotive corrosion where it starts by protecting concealed underbody and frame panels as well as painted outerbody surfaces that have been chipped or scratched. The very principle from which the automotive cathodic protection systems was designed ensures that the device's electrical counteraction will work hardest on those areas most susceptible to rust and corrosion. State of the art integrated circuitry and silicon chips monitor and respond to subtle changes in humidity, temperature, and other variables affecting rust formation, so the system offers maximum protection in all types of conditions. The system is compatible with sophisticated spray-on protective materials, none of which have proven lastingly effective against corrosion. The system can be considered a backup to any other rust-proofing method.

While no anticorrosion method can claim to be 100% effective the system when used as directed, can extend the life of a car's body by 75%. This means that the average car body life of eight years could be extended to 14 years. The dollar savings are obvious as evidenced by the potential for a much greater resale value beyond the fourth year of an automobile's life.

The only way to satisfy the electromotive forces set up by the electrolyte is to supply a readily available source of charged particles to act as current. Unfortunately, in vehicles unprotected by the system, the source of charged particles must be the metal itself, and rust and corrosion result.

The system supplies current to the electrolytes so a car's metals do not have to. Through the use of a car's battery and two strategically placed anodes, the device converts an entire car into a functioning cathode that supplies an electron flow to the entire car surface. Therefore, when a naturally occurring electrolyte creates a potential difference between metal parts of a car, the source for current flow becomes the car's battery, not its metal components. The effects of the electrolyte are disarmed by this superficial current flow, and the metal remains intact. Once the electrolyte is disarmed in this manner, rust and corrosion are drastically diminished.

Surface rust is very common in the dry and arid regions of the Southwest where the lack of rainfall and humidity prevents the formation of electrolytes. It is not uncommon to find 20 to 30 year old vehicles, mechanically worn out and abandoned, having solid bodies almost completely devoid of paint. These vehicles do not rot away with cavernous holes. Complete destruction of body panels and frame members simply does not occur because corrosion cannot begin without the presence of an electrolyte.

These vehicles have one extremely interesting point in common, i.e., their entire surface may have a red dust coating of iron oxide. This is because in areas of extremely low humidity, oxygen in the atmosphere combines with iron to produce ferric oxide hydrite, a crystalline compound that acts as a barrier against further oxidation of the iron. If an electrolyte were present, deep penetrating corrosion could occur, but because of the extreme lack of moisture, oxidation ceases almost immediately. For these reasons, it is completely normal to see this extremely light coating of surface rust even when using the system.

Aside from erosion by said and small stones abrading away body panels, all automotive corrosion is the result of the electro-chemical reaction set off by electrolytes. Poltice corrosion is a severe form of corrosion most often found in the underbody fender wells where mud, road salt, and moisture collect, forming a poltice. The salt in this poltice draws even more moisture from the atmosphere, making these areas prone to continuous corrosion action.

Stress corrosion occurs as a result of torsional effect on metal components. This tortional effect can be caused in one of two ways: (a) by the normal stress and movement of metal resulting from normal movement and vibration; or (b) by impact bending of body panels caused by external forces such as slight collisions with pebbles, other cars, or other objects. As the metal flexes, its crystalline structure gives away and releases metal ions.

Starting with a difference in potential, rust and corrosion is always the result.

Potential Difference. A potential difference is unavoidably built into steel during its manufacture. When steel is exposed to an electrolyte and oxygen, an electrochemical reaction takes place.

Temperature variations, such as sunlight on one side of a tank, can set up strong potential differences. Or, a combination of agitated and stagnant water areas is a condition that encourages corrosion.

Welds corrode fast. Heat from welding changes the potential in the weld area (charged particles of metal). These metal ions then react with the electrolyte, speeding up the corrosion process in the affected area.

Pit corrosion (described earlier) can occur whenever favorable conditions exist. But it is interesting to note that it is most active during a wetting/drying cycle, when the corrosion rate is actually enhanced and the pitting attack is most rapid. This pitting is not limited to cold weather. In fact, pitting activity increases as the temperature increases.

The real demons of rust and corrosion are electrolytes that permit electrical activity between the dissimilar metals and alloys of a car's frame and body components. The system provides the necessary electrons to disarm and render these electrolytes less active.

For corrosion in a joint a potential difference is set up between the oxygen-rich electrolyte and oxygen-starved electrolyte at the bottom of the crevice. This condition can occur at joints and welds where water is stagnant.

Pressure or stress in one area can change potential. Most times, the point of stress becomes an anode. This weakens the steel where strength is most needed. Stress points, such as bends or surface hardened areas, are good candidates for corrosion.

In the past 25 years the most common method of "rust proofing" car bodies involved spraying them with protective undercoatings. While these coatings do provide a certain amount of sound absorption and abrasion resistance, their record as corrosion inhibitors has proven less than effective. Application is difficult, and many corrosion-vulnerable areas of a car cannot be reached by even the most sophisticated spraying equipment. Furthermore, in as little as two and a half to four years, coated vehicles have shown extensive corrosion beneath the protective coating. This is because no matter how good the protective coating, electrolytes can eventually work their way through the coating to the metal below by the process of osmosis. This is why the device can serve as an effective backup to even the most respected undercoating systems.

Electrolytes can penetrate protective coatings by osmosis and attack the metal beneath. The coating will actually flake off the metal.

A car's battery is an ideal source of energy to power a cathodic protection device since it supplies direct current, the exact type of electrical current needed for this type of protection. Of course, the device does draw a small amount of power from the battery at all times, but when compared to the savings on the car's body, the wear on the battery is truly negligible. For example, under normal use (driving a car 100 or more miles per week), the battery will have sufficient opportunity to recharge. If a car is stored for 30 days without operating it, there will be an appreciable drain on the battery, but most good quality batteries will still retain enough reserve to start the engine and begin the recharging cycle. The device also incorporates a unique pulsating system that allows a battery to use its rejuvenating properties more effectively.

Cathodic protection is not new. It has been used extensively to protect underground pipelines, reinforcement bars on bridges, and ocean going vessels. Industries with high capital investment, such as petroleum, shipping, construction, and exploration, have always recognized the value of extending the useful life of their metal goods.

In the automobile industry, the incentive to extend the life of the product simply did not exist.

Reasoning that it would cut down future sales, those in the industry considered it unthinkable to build a vehicle that would last beyond ten years.

In accordance with the device described above, the invention provides carbon anodes. The composition of the anodes is about 98% carbon and about 2% silica gel, with less than 1% of the anode containing inert binders. The components are sintered, then combined homogeneously, evenly mixed, and extruded as a high density compressed mass. The material is reduced to specific anode size as required. This anode is deemed carbosil to reflect the carbon and silica nature of the composite. The carbosil anode has been designed to meet requirements of impressed current design. The dessicants, i.e., less than 5% of total composition, are sensitive to atmospheric moisture and thereby vary conductivity to protective surfaces. As the humidity increases, the associated electrolytic corrosion effect increases. In response, the carbosil anode increases the conductivity to protective surfaces. Therefore, the addition of moisture-sensitive compounds to the carbon anodes increases the distribution of current necessary to disarm the corrosive effect of the electrolyte.

The properties of the carbosil anode are:

a. Bulk Density—0.0625 lbs/cu. in.
b. Maximum Grain Size—0.035 inch
c. Specific Resistance—0.00039 ohms/in.
d. Compression Strength—5200 PSI
e. Porosity—25%
f. Tensile Strength—1800 PSI
g. Thermal Conductivity—0.25 BTU/$FT_2$ sec. F.

Referring now to FIG. 1, an anode 16 is made of sintered material which is generally indicated by the numeral 10. The side of the anode to be in contact with the car body is 14. The side of the anode to which the electrolyte attaches is 12. pâ. The threaded fastener for attaching the anode 16 to the car body is 40. It is preferred this be of a plastic or a dielectric material such as a polyamide, i.e., nylon. The electrical lead 32 has a ring connector 30 attached to the electrical lead. The ring connector has a sleeve 34 adapted to receive the lead 32. The ring 36 has a hole 38 through which threaded fastened 40 may be inserted. The hole 38 is in alignment with hole 18.

Figure 2:
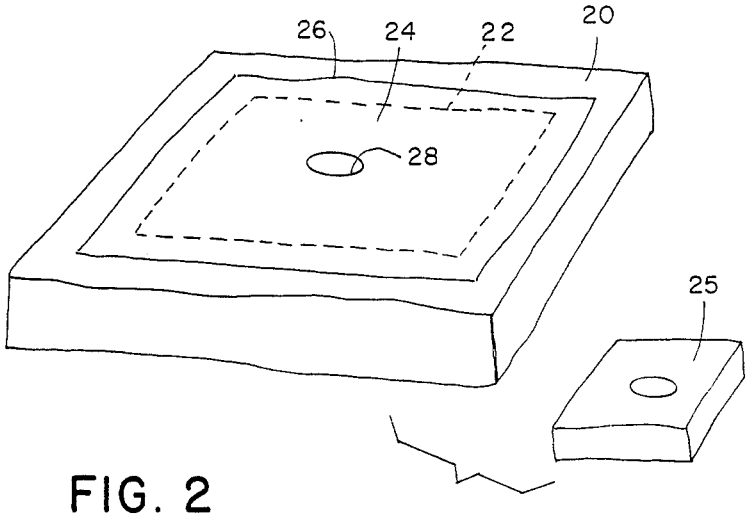
FIG. 2 is an elevated perspective of a prepared surface which would receive the embodiment of FIG. 1

FIG. 2 depicts a section of car body. A hole 28 extends therethrough for receiving threaded fastened 40. The area encompassed by dotted line 22 represents the bare metal surface which has had paint removed from it. This surface, 24, will be the primary area of conductance. The area encompassed by line 26 is the area which has been coated with the anode enhancement liquid. Essentially, a surface of the metal has been cleaned free of any coating material and then has been painted, with a little bit of overlap onto coated areas, with an enhancement or electrical enhancement material. This material comprises: 41% $H_2O$, 24% polyvinyl acetate-acrylic resin, 23% calcium silicate pigment, 4% sodium silicate stabilizer, 3% of a 10% molar solution of phosphoric acid, 3% of a 10% molar solution of tannic acid, 1.5% glycol esters and 0.5% inert material. The purpose of the fluid is to enhance the electrical conductivity of the surface 24.

The surface 20 on FIG. 2 is that area of the car body surface which has not been touched with the process of attaching the invention.

On a back side of surface 24 there is located a plastic dielectric nut 25 for receiving the threaded fastener 40. It is important that this nut be made of a polyamide or similar material such that when overtightening occurs the nut will strip before the anode is crushed.

Figure 3:
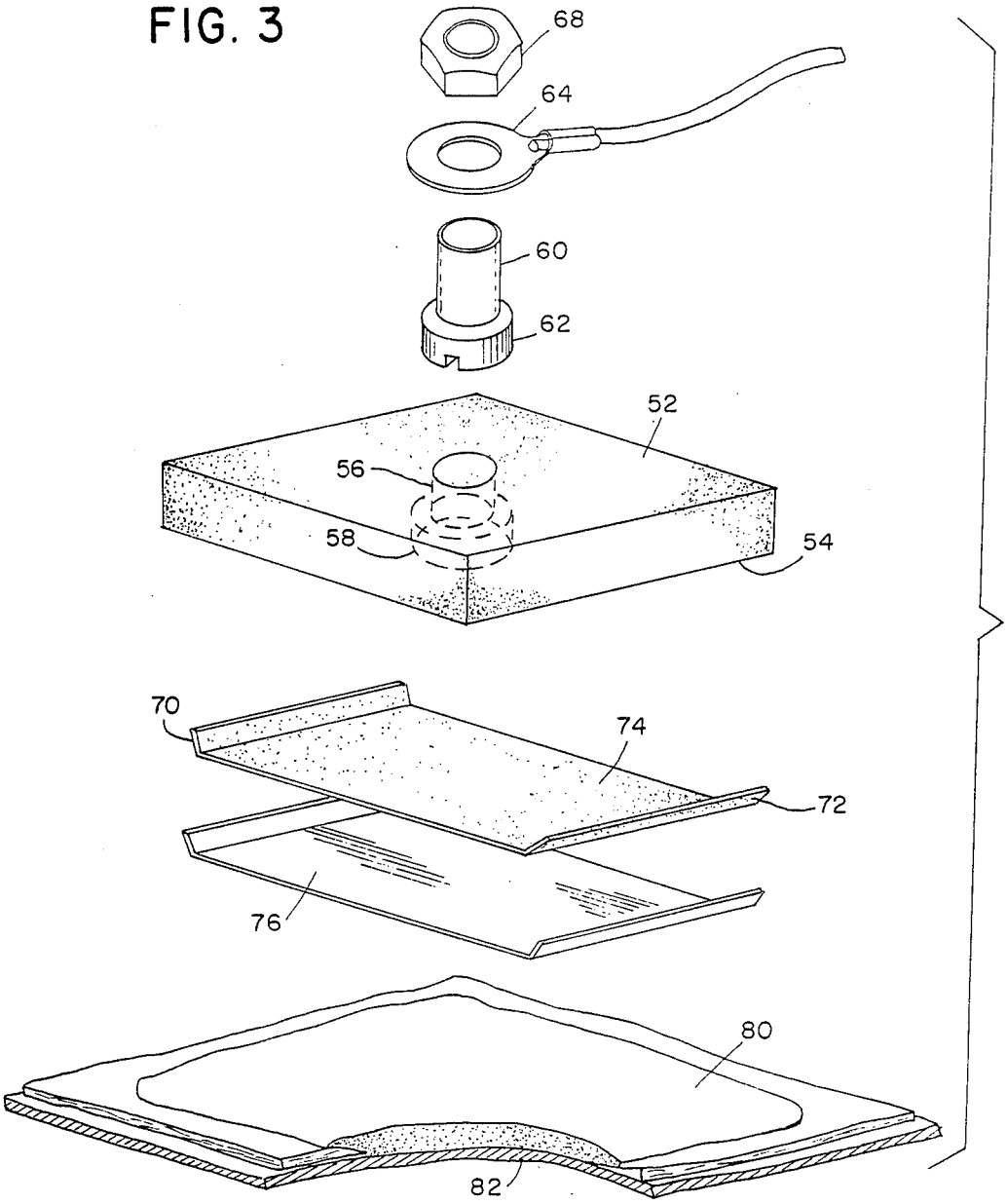
FIG. 3 shows a construction attachment of a conductor to an anode on an anode to an automotive body.

A form of the invention is shown in FIG. 3. An anode 50 has first and second sides 52 and 54. A hole 56 extending through the anode 50 is countersunk 58 on side 54 to receive a head 62 of a threaded plastic fastener 60, which project beyond side 52. A ring connector terminal 64 fits over fastener 60 and is held lightly against side 52 of anode 50 by a plastic nut 68. Alternatively, connector 64 may be held on surface 52 by a conductive adhesive. Alternatively, a suitably shaped connector 64 may be potted or otherwise held on the anode by any suitable means.

A double sided tape 70 has adhesive 72 and 74 on opposite sides. One side 72 is attached to side 54 of anode 50, covering the countersunk or flush head 62 of the fastener 60.

Adhesive 74 of tape 70 is covered by a conventional release sheet 76.

Adhesive 74 may be attached to an AEL layer 80 coating bared metal 82. Alternatively, adhesive 74 adheres the tape and the anode to an area such as 84 where an AEL layer covers conventional paint 86.

Alternatively, the adhesive 74 attaches the tape and the anode directly on the paint 86 such as at location 88.

The power source for this invention is from the automotive battery with 12 volt potential. Since the automotive system uses a negative ground the output terminal block will be positively charged. In essence, the automotive body becomes the cathode and the output terminals supply the impressed electric charge that disarms the electrolyte, thereby reducing automotive body corrosion.

Figure 4:
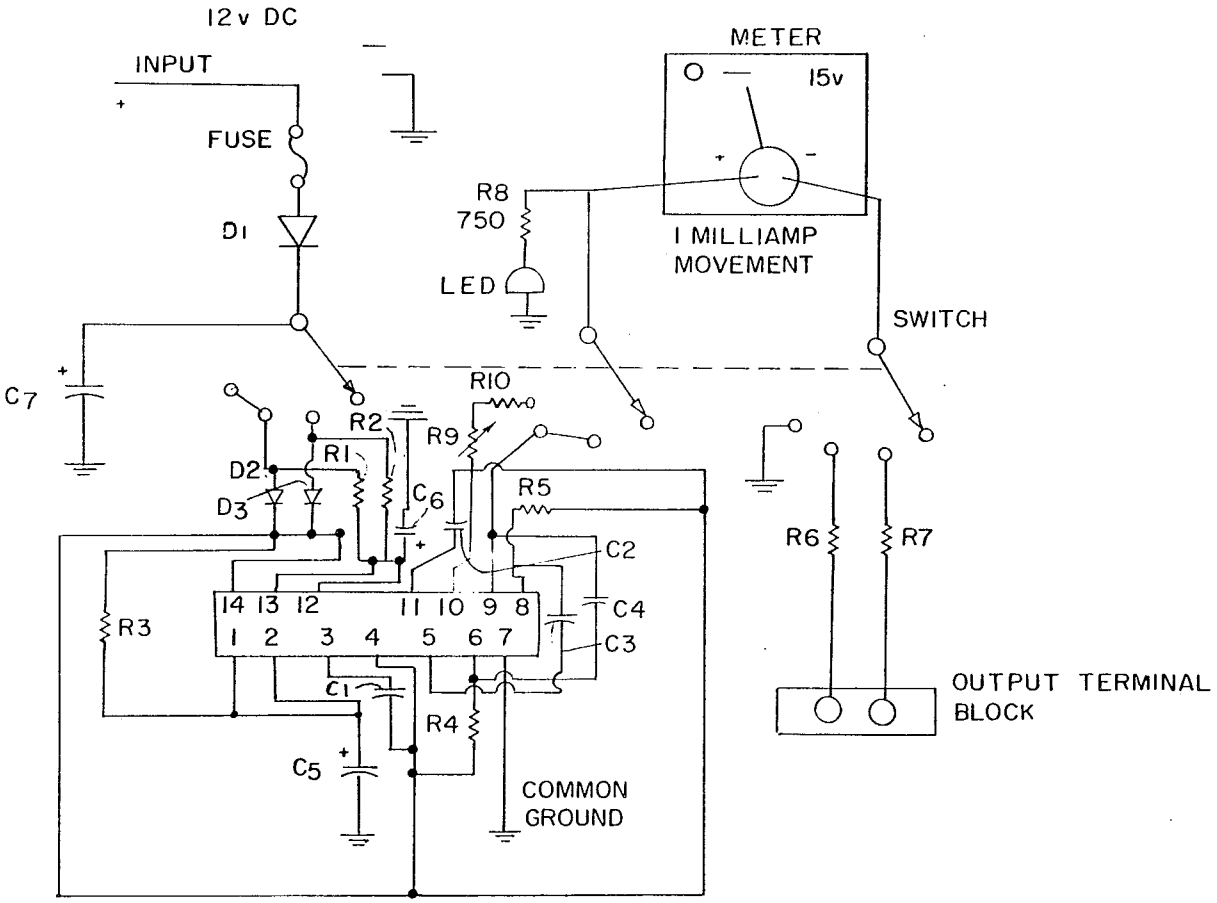
FIG. 4 is a schematic diagram of a control circuit.

Referring to the circuit shown in FIG. 4, the output terminal block is controlled by a three pole four position switch. Position 1 is off. Position 2 (R7) is standard output voltage and time duration. Position 3 (R6) is 200% increase in time and impressed current over position 2 (R7). Position 4 activates volt meter to monitor system voltage. The figure shows a power source means for supplying direct current, switch means connected to the power source means for controlling application of the power source means, timer and power control means connected to the switch means for controlling power over a predetermined time when the switch means connects the power source means to the timer and power control means, and output means connecting the power and timer control means to a vehicle body.

Figure 5:
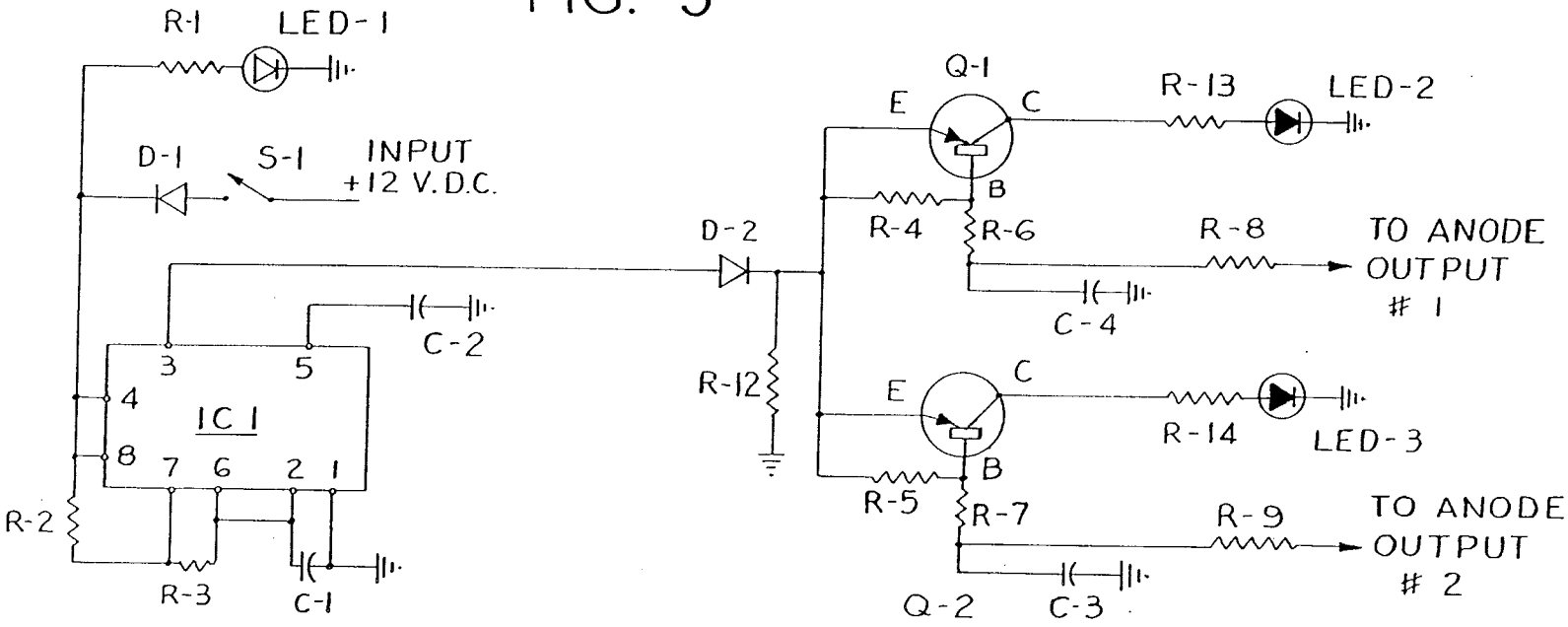
FIG. 5 is a schematic diagram of the preferred control circuit for the system using carbosil anodes.

The preferred power supply and voltage control system for use with the carbosil anodes is shown in FIG. 5.

In a preferred device, 12 volt power is supplied through switch S-1 to diode D-1. Power "on" is indicated at light emitting diode (LED) LED-1 which is connected to resistor R-1. The automatic corrosion protection system is powered directly to the battery of a vehicle. A cathode is attached directly to the body and an anode or anodes are adhered to the surface. Preferably, the anodes are attached at or near wheel wells in areas of high moisture exposure.

Supply voltage is fed directly through a resistor R-1 to LED-1 which indicates that the system is connected for operation.

Power from the power source is fed through diode D-1 directly to terminals 4 and 8 of an oscillator timer integrated circuit IC-1. Resistor R-2 is connected between terminals 7 and 8 of IC-1 and resistor R-3 is connected between terminals 6 and 7. Capacitor C1 is connected between terminals 1 and 2. Capacitor C-2 is connected to terminal 5. Terminal 3 is the output of IC-1 on which a control signal is produced.

Figure 6:
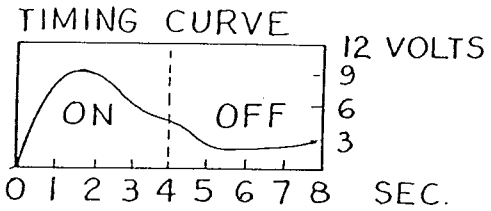
FIG. 6 is a time/voltage graph showing the eight-second cycle of the preferred control circuit.

The circuit of FIG. 5 processes the 12 volt input voltage from the power supply into a timed output impulses of a maximum of 11.2 volts to a minimum of 3.2 volts over an 8-second time period. The corresponding electrical current reaches a peak of 1.5 ma during the second second of the "on" cycle and diminishes to a minimum of 0.006 ma during the "off" cycle. As shown in FIG. 6, the timing cycle provides a 4-second "on" period and a 4-second "off" period. The voltage and current are inhibited from returning to zero during the "off" cycle by the parallel capacitors in the output circuit.

The oscillator circuit IC-1 supplies pulses to transistors Q-1 and Q-2, each having emitter E, base B, and collector C. Supply pulses first pass diode D-2 and resistor R-12.

The power supply, when coupled to inert anodes fastened to an automobile's body through an infinitely high resistance, causes a build-up of electrons on the automotive body beneath the painted surface. The dielectrically attached anodes on the vehicle's body become overwhelmingly positive. As the power supply cycles "on" and "off", a capacitance is created between the negative automobile body and the positive anodes. The potential for electron discharge through breaks in the automotive paint, which is dielectric, provides the voltage and current that interferes with the rusting process. The capacitance is affected and is proportional to the electrolyte and its concentration of ions that exists either as a film of moisture, such as high relative humidity, or a bath of water between the anode and the automotive body at breaks in the dielectric automotive paint.

The carbosil inert anodes previously discussed have an interacting sensitivity in moisture-laden air adjacent to the surface of the automotive body because of their moisture attracting nature.

The most important aspect of the anodes used in the system described above is the ability to create capacitance, with the anodes acting as the positive plate of a capacitor relative to the ferrous metal structure which is the negative plate. The dielectric separating positive and negative plates is the paint covering the metal structure or a dielectric coating on the ferrous metal.

Preferred anode material has been described as "carbosil", containing carbon and silica. Other materials may be used so long as capacitance can be created as described previously. Capacitance provides the unique ability for current to bleed off while power is in the off cycle. This is due to the ability of capacitors to store charges.

Other anode materials may include zinc, solid carbon (no silica), magnesium, and aluminum.

In another embodiment, an anode material is prepared as a spray on or coating or otherwise moldable substance having granulated carbon, silicon, and silica gel. Preferably, granulated carbon comprises at least 50% of the mixture. More particularly, the preferred anode material would comprise 38% silicon, 2% silica gel, and 60% granulated carbon. The material would be applied to a surface and would receive lead wire connections necessary to connect the power source to the anode material.

The material could be poured into one of the capsules described in my copending application entitled "Carbosil Anodes", filed Feb. 26, 1987, for the purpose of forming an anode within the capsule. Slots or other openings provided in the capsule would have to be covered temporarily to hold the anode material.

In another variation, the anodes could be formed as carbon filament lattice grid material, which could be made of nylon or fiberglass impregnated with carbon and woven into a matting. The matting lattice would have a wide dimensional characteristic of filament diameter and lattice separation.

All of the variations of anodes mentioned above would use the preferred bonding technique in which Isotac tape or epoxy resin is used to bond the anode directly to the ferrous metal dielectric material or paint.

Values for preferred components are as follows:

| ITEM | DESCRIPTION |
|---|---|
| IC 1 | *555 timing chip |
| R-1, R-2 | 1K ¼ watt |
| R-3 | 124 K |
| R-4, R-5 | 2.2 K |
| R-6, R-7 | 1 K |
| R-8, R-9 | 5.6 K |
| R-12 | 470 K |
| R-13, R-14 | 680 K |
| LED 1, 2, 3 | 2.5 V |
| D-1, D-2 | IN 4004 |
| S-1 | TEC 101 |
| Q1, Q2 | 2N 3906 |
| C-1 | 47 Fd |
| C-2 | .01 Fd |
| C-3, C-4 | 47 Fd |

Output to anodes 1 and 2 ranges from 3.2 V to 11.2 V and seconds off. More or less anode may be used, depending on the needs of the vehicle. The circuitry can easily be adapted to a change in the number of anodes.

Each transistor Q-1 and Q-2 is connected through resistors R-13 and R-14, respectively to LED's, LED-2 and LED-3, which indicate by illumination the flow of current to the anodes.

As this invention may be embodied in several forms without departing from the spirit or essential characteristics thereof, the present embodiment is therefore illustrative and not restrictive, and whereas the scope of the invention is defined by the appended claims, all changes that fall within the metes and bounds of the claims or that form their functional as well as their conjointly cooperative equivalents are therefore intended to be embraced by those claims.

What I claim is:

1. Automotive corrosion protection apparatus comprising power source means for supplying direct current, switch means connected to the power source means, integrated circuit timing means connected to the power source means for generating a timed output impulse and controlling power over a predetermined timing cycle, and output charge storage means connecting the power and timer means to a vehicle body.

2. The apparatus of claim 1 wherein the output means comprises at least one positive anode and the vehicle body comprises a negative cathode.

3. The apparats of claim 2 wherein the anode and cathode are separated by a dielectric body paint.

4. The apparatus of claim 3 wherein the output impulse of the timing means creates a capacitance charge creating the negative vehicle body and the positive anode a potential for electron discharge through breaks in dielectric automotive paint providing voltage and current that interferes with rusting by supplying electrons to the metal.

5. The apparatus of claim 4 wherein the capacitance is affected and proportional to an electrolyte existing as humidity of as a film of moisutre between the anode and the vehicle body at breaks in the automotive paint.

6. Automotive cathodic protection apparatus comprising power source means for supplying direct current, switch means connected to the power source means for controlling application of the power source means, integrated circuit timer and power control means connected to the switch means for controlling power over a predetermined time when the switch means connects the power source means to the timer and power control means, and output charge storage means connecting the power and timer to a vehicle body.

7. The apparatus of claim 6 wherein the integrated circuit timer and power control means comprises an eight pin "5-5-5" circuit having connections to the switch means, to ground and to the output charge storage means.

8. The apparatus of claim 7 wherein a first pin is connected to a ground, a second pin is connected to a first capacitor to ground, a third pin is connected to the output means, a fourth pin is connected to the switch means, a fifth pin is connected through a second capacitor to ground, a sixth pin is connected to the second pin.

9. The apparatus of claim 8 further comprising a light emitting diode indicator connected through a first resistor to the switch means for indicating an on condition of the apparatus, a second resistor being connected between seventh and eighth pins of the integrated circuit means and a third resistor being connected between the sixth and seventh pins of the integrated circuit.

10. The apparatus of claim 9 further comprising a first diode connected to the switch means, a second diode connected between the integrated circuit means and the output charge storage means and wherein the output charge storage means comprises resistance means connected to an output and capacitance means connected between the resistance means and ground.

11. The apparatus of claim 10 wherein the output means comprises first and second outputs and wherein the resistance means comprises first and second resistance means respectively connected between the second diode and the first and second outputs and wherein the capacitance means comprises first and second capacitance means respectively connected between the first and second resistance means and ground.

12. The apparatus of claim 11 further comprising first and second indicator controls connected to the second diode and first and second indicators respectively connected to the first and second indicator controls for energizing the indicators when the second diode is energized.

13. The apparatus of claim 12 wherein the first and second indicator controls comprise first and second transistors having first and second bases respectively connected to the first and second resistance means and wherein the first and second indicators comprise first and second light emitting diodes.

14. The apparatus of claim 13 wherein the first and second resistance means each comprise transistor base-biasing resistors and output current limiting resistors.

15. The apparatus of claim 14 wherein the first and second capacitance means comprise first and second capacitors connected to ground and respectively connected to the first and second resistances between the base-biasing resistors and the output current limiting resistors.

16. The method of automotive cathodic protection comprising providing automotive battery power to pins of an integrated circuit timer and power control and periodically switching on and off from the integrated circuit timer and power control, periodically supplying cathodic protection current, charging storage means with the current, supplying the current and discharging the storage means over a wetted painted automotive surface and limiting the supplying of the current and the discharging of the storage means.

17. The method of claim 16 further comprising indicating periods of the supplying of the current.

18. The method of claim 17 wherein the indicating comprises controlling a transistor with a base current limiting resistor and a biasing resistor and illuminating an LED through an emitter collector circuit of the transistor and through a current limiting resistor while the cathodic protection current is supplied.

19. The method of claim 17 wherein the supplying and discharging further comprises supplying output to first and second anodes from the supplied current and from first and second charge storage capacitors through first and second current limiting resistors and wherein the indicating comprises controlling illumination of first and second LEDs by supplying the current to first and second transistors.

* * * * *